US005575725A

United States Patent [19]

Olsavsky

[11] Patent Number: 5,575,725

[45] Date of Patent: Nov. 19, 1996

[54] GOLF CLUB HOSEL CONFIGURATION

[75] Inventor: Thomas M. Olsavsky, Escondido, Calif.

[73] Assignee: Acushnet Company, Fairhaven, Mass.

[21] Appl. No.: 465,279

[22] Filed: Jun. 5, 1995

[51] Int. Cl.[6] ..... A63B 53/04

[52] U.S. Cl. ..... 473/317; 473/314; 473/327

[58] Field of Search ..... 273/80.2, 80.3, 273/80.4, 80.5, 80.6, 80.8, 167 R, 169, 173, 174, 172, 167 A, 167 B, 167 E, 167 F, 167 G, 167 H, 167 J, 167 K

[56] References Cited

U.S. PATENT DOCUMENTS

| | | | |
|---|---|---|---|
| 959,053 | 5/1910 | Fowler | 273/167 E |
| 1,396,470 | 11/1921 | Taylor | 273/167 E |
| 1,514,958 | 11/1924 | Dutcher | 273/167 E |
| 1,528,017 | 3/1925 | Gammeter | 273/167 E |
| 1,587,758 | 6/1926 | Charavay | 273/167 E |
| 1,787,415 | 12/1930 | Washington | 273/167 E |
| 2,018,723 | 10/1935 | Hutchison | 273/80.2 |
| 2,027,635 | 1/1936 | Cunningham | 273/80.2 |
| 2,088,095 | 7/1937 | Sargent et al. | 273/167 E |
| 3,947,041 | 3/1976 | Barber | 273/167 G |
| 3,985,363 | 10/1976 | Jepson et al. | 273/173 |
| 4,892,316 | 1/1990 | Langert et al. | 273/167 E |
| 5,120,061 | 6/1992 | Tsuchida et al. | 273/167 E |
| 5,230,510 | 7/1993 | Duclos | 273/80.2 |
| 5,467,988 | 11/1995 | Henwood | 273/174 |

FOREIGN PATENT DOCUMENTS

| | | | |
|---|---|---|---|
| 800882 | 7/1936 | France | 273/167 E |
| 489638 | 9/1938 | United Kingdom | 273/167 E |
| 1078412 | 8/1967 | United Kingdom | 273/167 E |
| 2012597 | 8/1979 | United Kingdom | 273/167 E |

OTHER PUBLICATIONS

Golf Digest, "Shamrock", p. 68.

*Primary Examiner*—Steven B. Wong
*Attorney, Agent, or Firm*—Pennie & Edmonds

[57] ABSTRACT

A golf club having a shaft with an aerodynamic hosel with defined shape. The clubhead also may have a trip step, a taper toe and runners.

9 Claims, 10 Drawing Sheets

GOLF CLUB HOSEL CONFIGURATION

BACKGROUND OF THE INVENTION

Prior patents have suggested use of configured hosels to create aerodynamic effects (U.S. Pat. Nos. 1,514,958, 1,787,415, 2,018,723, and 5,120,061).

SUMMARY OF THE INVENTION

Broadly, the invention comprises a golf club with head and shaft, preferably a wood-type club, having a configured hosel including an aerodynamic fairing surface, having a front semicircular surface in front of the shaft and trailing generally oval surface behind the shaft. The fairing surface on the heel side of the shaft is larger than the surface on the toe side of the shaft. The surfaces are angled to the intended line of flight which line is perpendicular to the face of the club head.

It is also a feature that the head has in addition to the fairing surface, a trip step, tapered toe, and novel sole design.

DESCRIPTION OF THE PREFERRED EMBODIMENT

Figure 1:
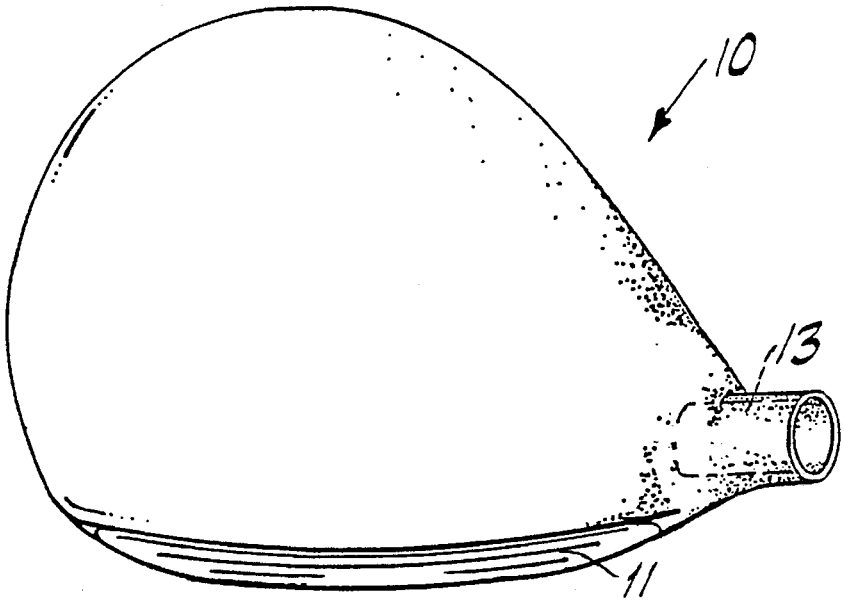
FIG. 1 is a top view of the golf club including hosel of the invention.
Figure 2:
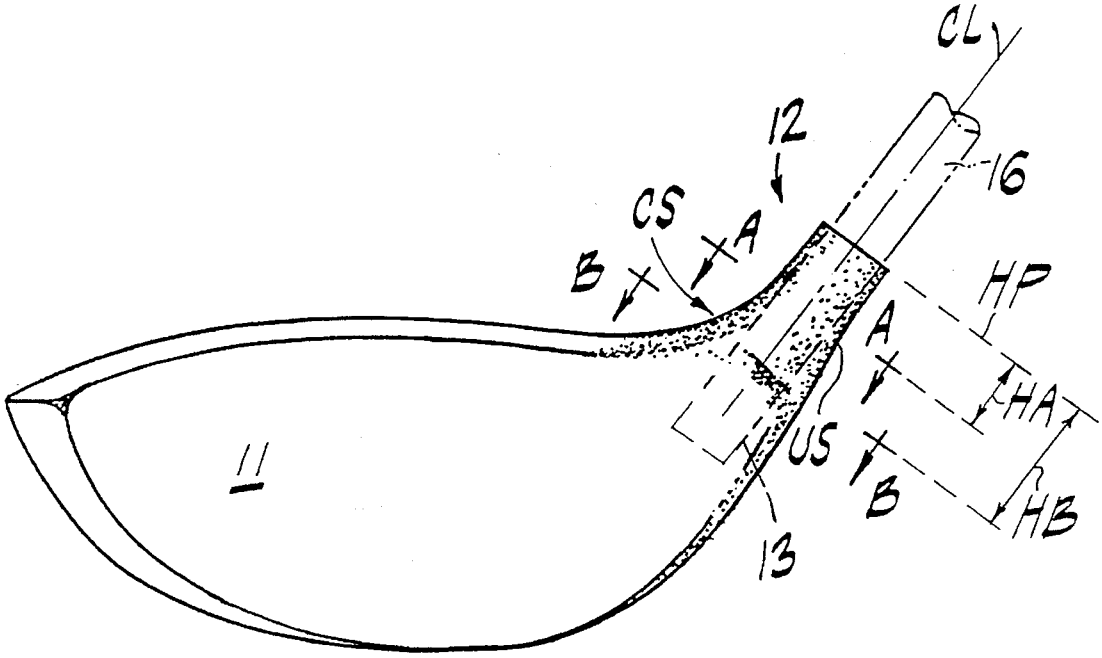
FIG. 2 is a front face view of such head including hosel and a portion of the shaft.

In FIGS. 1–5, club head 10 includes ball striking face 11, hosel 12, shaft-receiving recess 13 and shaft portion 16 (see FIG. 2).

Figure 3:
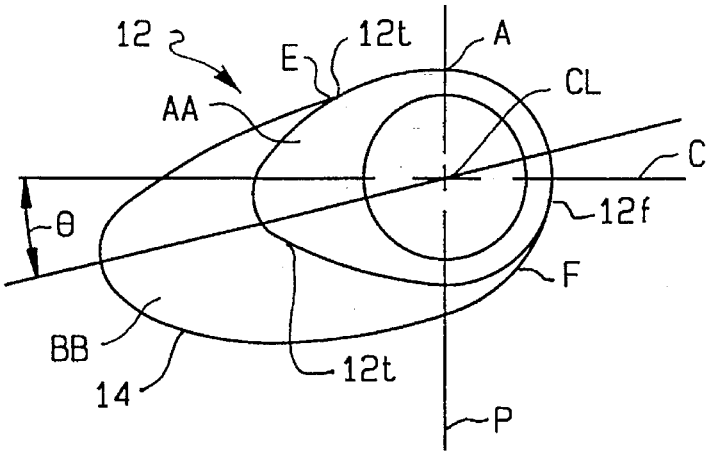
FIG. 3 shows sectional views AA and BB of FIG. 2.
Figure 4:
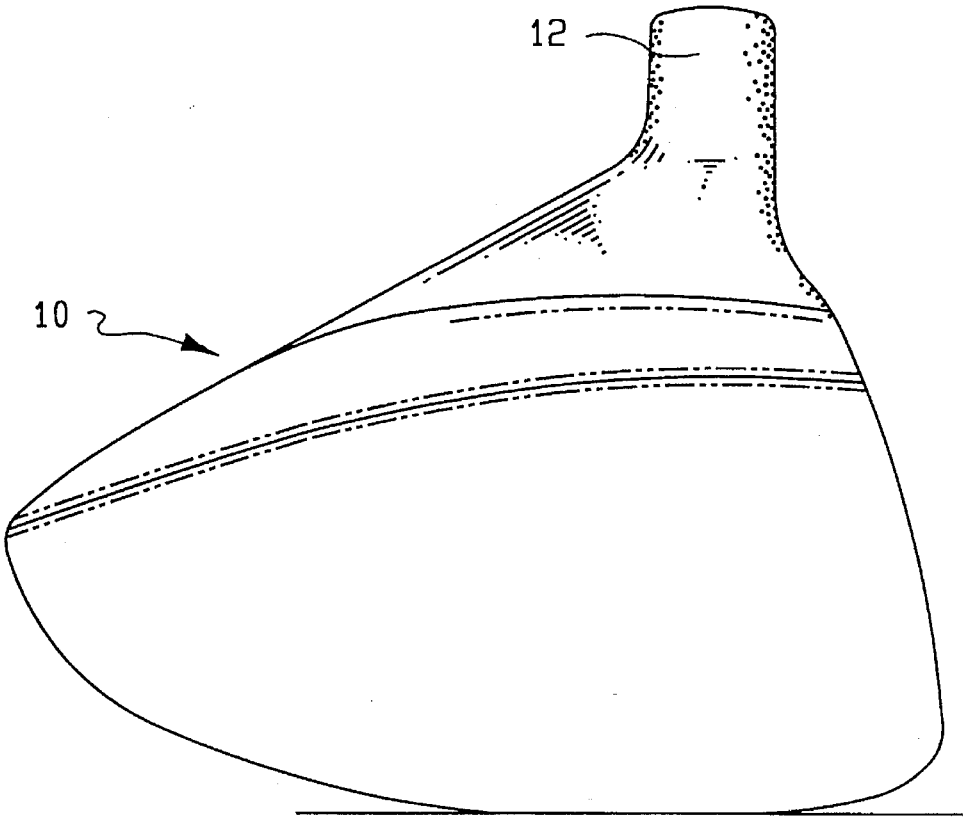
FIG. 4 is a toe view of the head including hosel and shaft.

FIG. 3 includes two (2) sectional planes AA and BB which intersect with hosel 12 comprising generally semicircular forward line 12*f*, or half oval surface which extends in both such sectional planes AA and BB between points A and F on the right side of plane P (as viewed in FIG. 3). The trailing or fairing line 12*t* in plane AA extends from A to F on the other side of plane P defining a teardrop shape. Plane BB creates a surface line 14 extending between points E and F. The circumferential hosel profile surface CS is the hosel surface between planes AA and BB which surface goes completely around hosel 16 (see FIG. 2). Profile surface CS provides for novel aerodynamic action during club swinging. The upper surface US' of the hosel 16 above plane AA is substantially cylindrical.

Further details of planes AA and BB are shown on Figs. 3*a*, 3*b* respectively and in Tables IA and IB below in which dimensions are inches:

TABLE IA

Figure 3A:
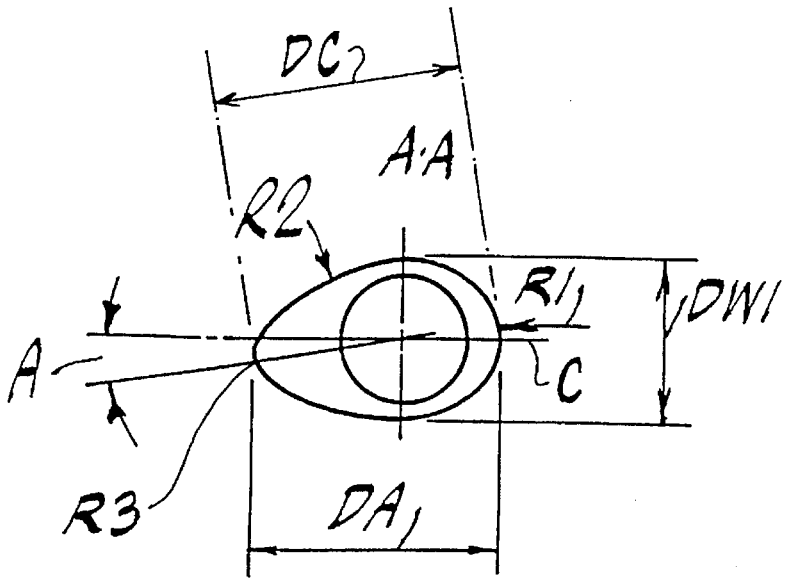
FIG. 3*a* further describes section AA with dimensional notations.

| Section AA FIG. 3a | FIGS. 6–9a | FIGS. 1–5a |
|---|---|---|
| Size DA | 0.95 | 0.6 |
| Size DW1 | 0.6 | 0.5 |
| Size DC | 0.97 | 0.92 |
| Angle A (to target:line C) | 12° | 12° |
| Radius R1 | 5/16 | 1/4 |
| Radius R2 | 10 | 5 |
| Radius R3 | 7/64 | 1/16 |
| Height HA, HA' (FIGS. 2, 7) | 0.3 | 0.3 |

TABLE IB

Figure 3B:
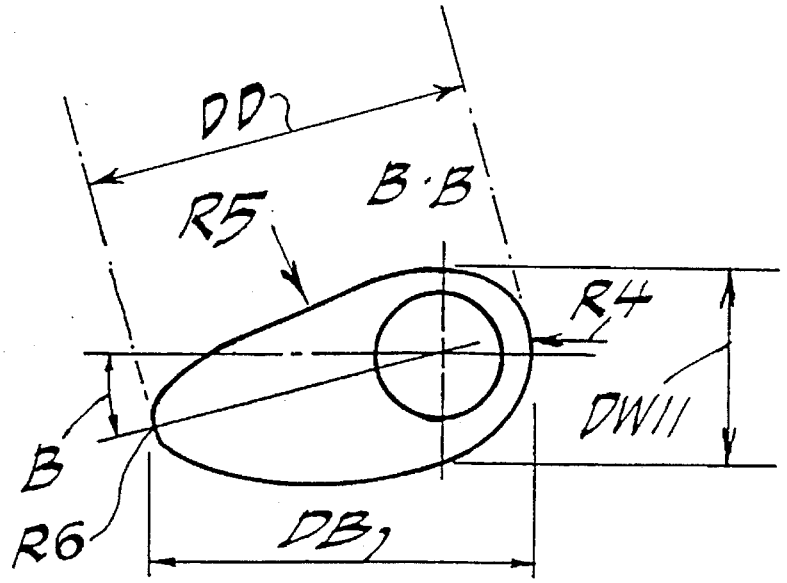
FIG. 3*b* further describes section BB with dimensional notations.
Figure 6:
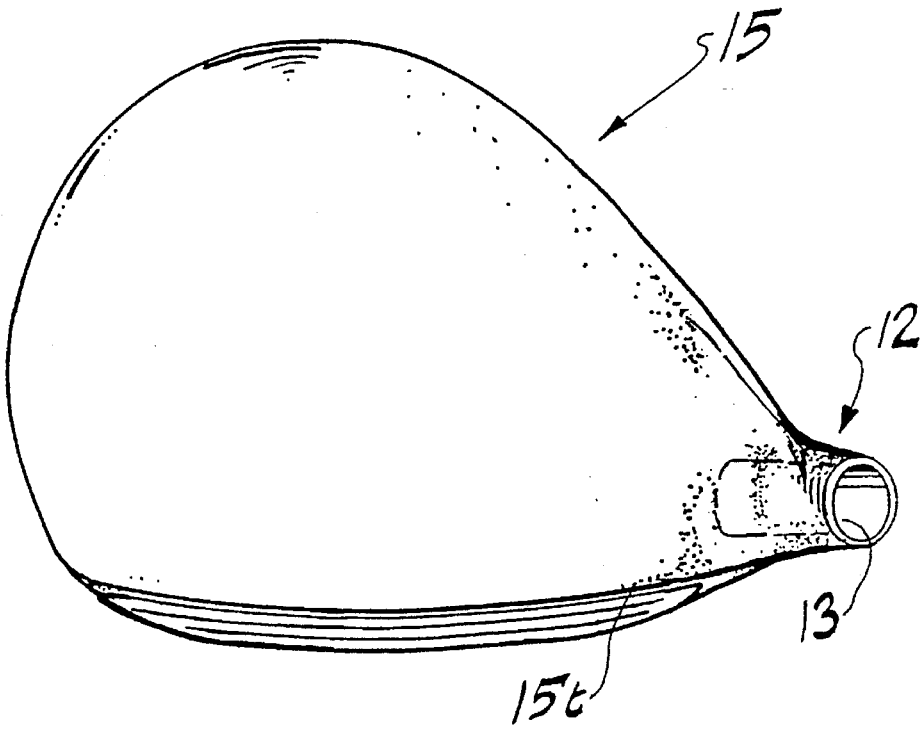
FIG. 6 is a plan view of an alternative head and hosel.

| Section BB FIG. 3b | FIGS. 6–9a | FIGS. 1–5a |
|---|---|---|
| Size DB | 1.27 | 0.88 |
| Size DW11 | 0.75 | 0.6 |
| Size DD | 1.29 | 0.9 |
| Angle B (to target:line C) | 14° | 14° |
| Radius R4 | 7/16 | 1/2 |
| Radius R5 | 12 | 6 |
| Radius R6 | 1/8 | 5/64 |
| Height HB, HB' (FIGS. 2, 7) | 0.5 | 0.5 |

Figure 5:
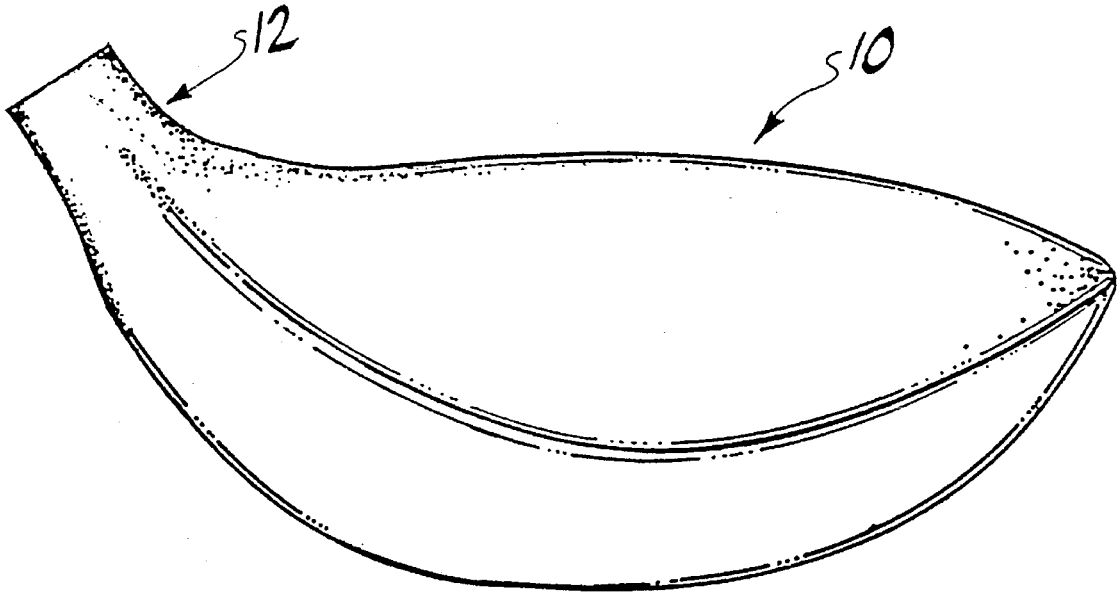
FIG. 5 is a rear view of the head including hosel.
Figure 5B:
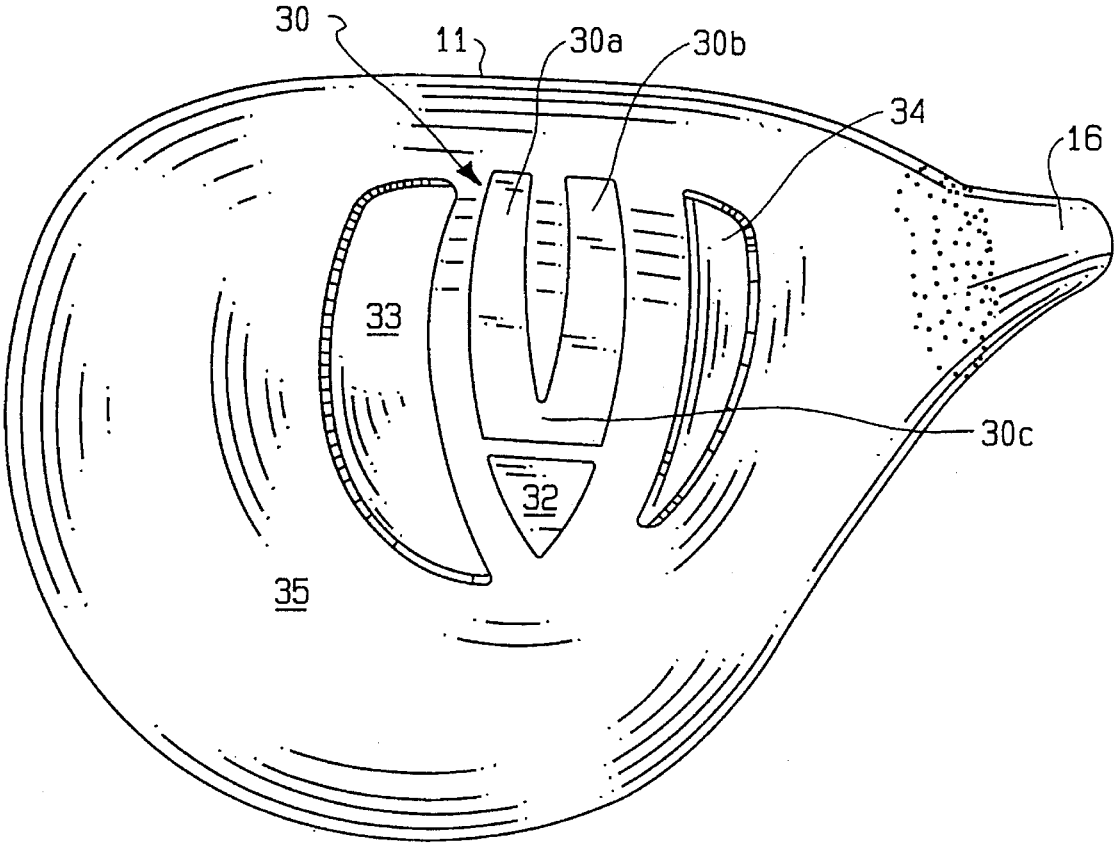
FIG. 5*b* is a bottom view of the head including hosel.

FIG. 5*b* shows the head bottom surface 35 a dual raised runner piece 30 consisting of raised first runner 30*a* and raised second runner 30*b* which runners are connected at base 30*c*. Adjacent runner piece 30 is a raised triangle 32. Runners 30*a*, 30*b* and triangle 32 are raised above the bottom surface about between 0.020–0.50 inch depending on the loft of the club head with deeper runners for higher lofts. Runner piece 30 assists in guiding head 10 and reducing resistance as it passes against or through grass and ground during the swing. Also shown are head bottom recesses 33, 34.

Figure 7:
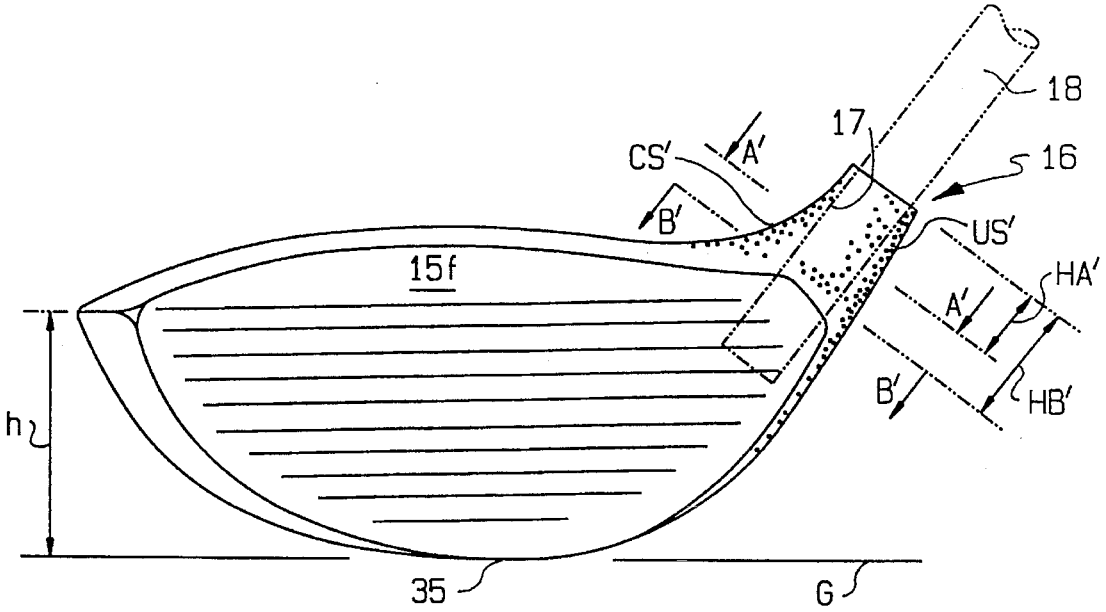
FIG. 7 is a front face view of the embodiment of FIG. 6.
Figure 8:
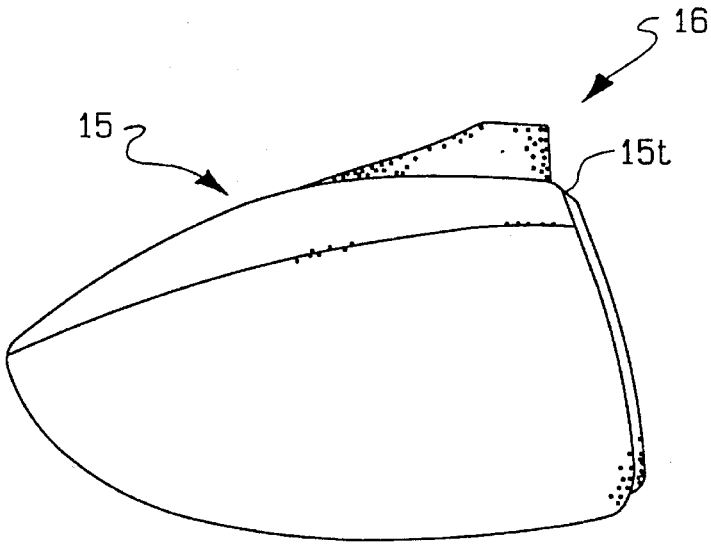
FIG. 8 is a toe view of the embodiment of FIG. 6 showing the trip step slightly exaggerated in size for illustrative purposes.
Figure 9:
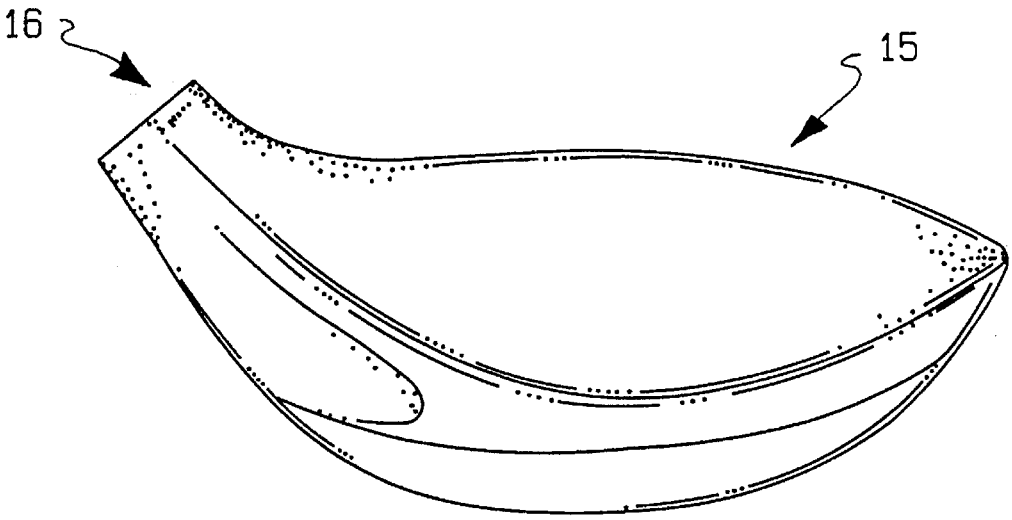
FIG. 9 is a rear view of the FIG. 6 embodiment.
Figure 9A:
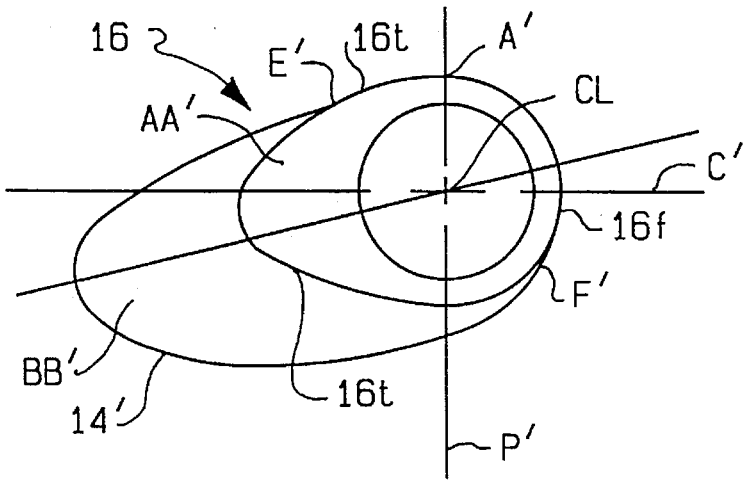
FIG. 9*a* shows a sectional views AA' and BB' of FIG. 7.

FIGS. 6–9*a* show an alternative embodiment in which a larger head 15 has ball striking face 15*f*, trip step 15*t*, hosel 16 and shaft-receiving recess 17. Also shown is partial shaft 18. FIG. 9*a* includes two (2) sectional planes AA' and BB' similar to FIG. 3. Hosel 16 between such sectional planes has a semicircular front surface 16*f* and trailing (fairing) surface 16*t* similar to the embodiment of FIG. 3. The profile surface is CS'. In FIG. 7, the area enclosed by a rectangle defined by height h and base G is reduced over prior conventional heads to provide a head with a tapered toe.

Figure 10:
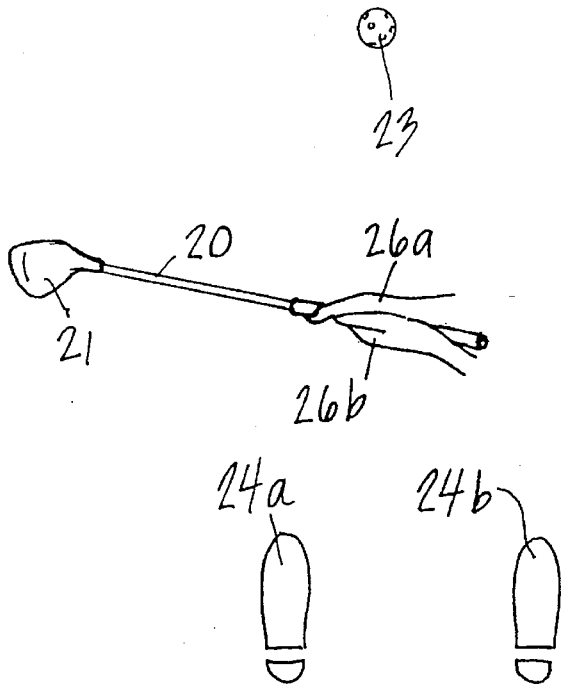
FIG. 10 is an overhead schematic view of the golf club of the present invention positioned to be swung down by a golfer.
Figure 10A:
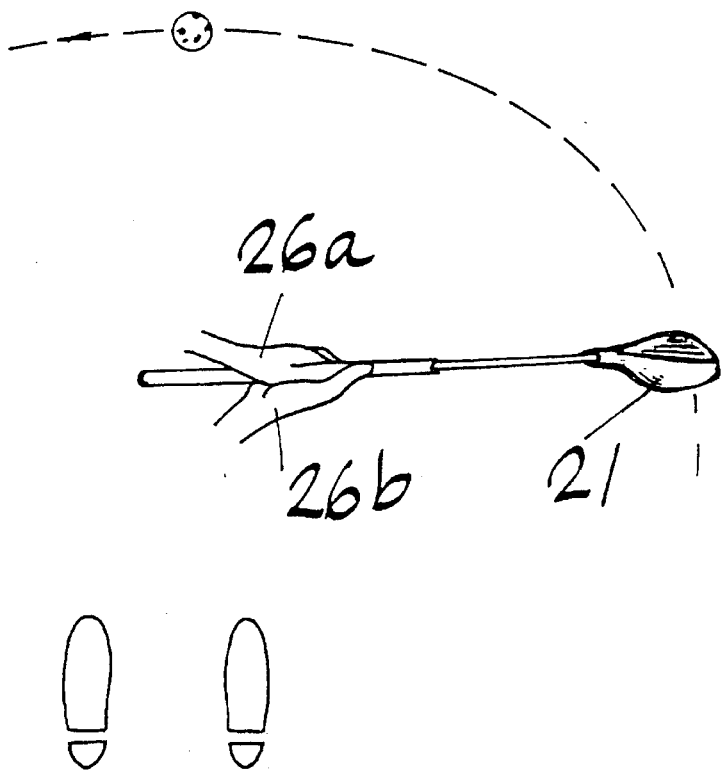
FIG. 10*a* is a view similar to FIG. 10 showing the club having progressed downwardly to a position where the shaft is horizontal.
Figure 11:
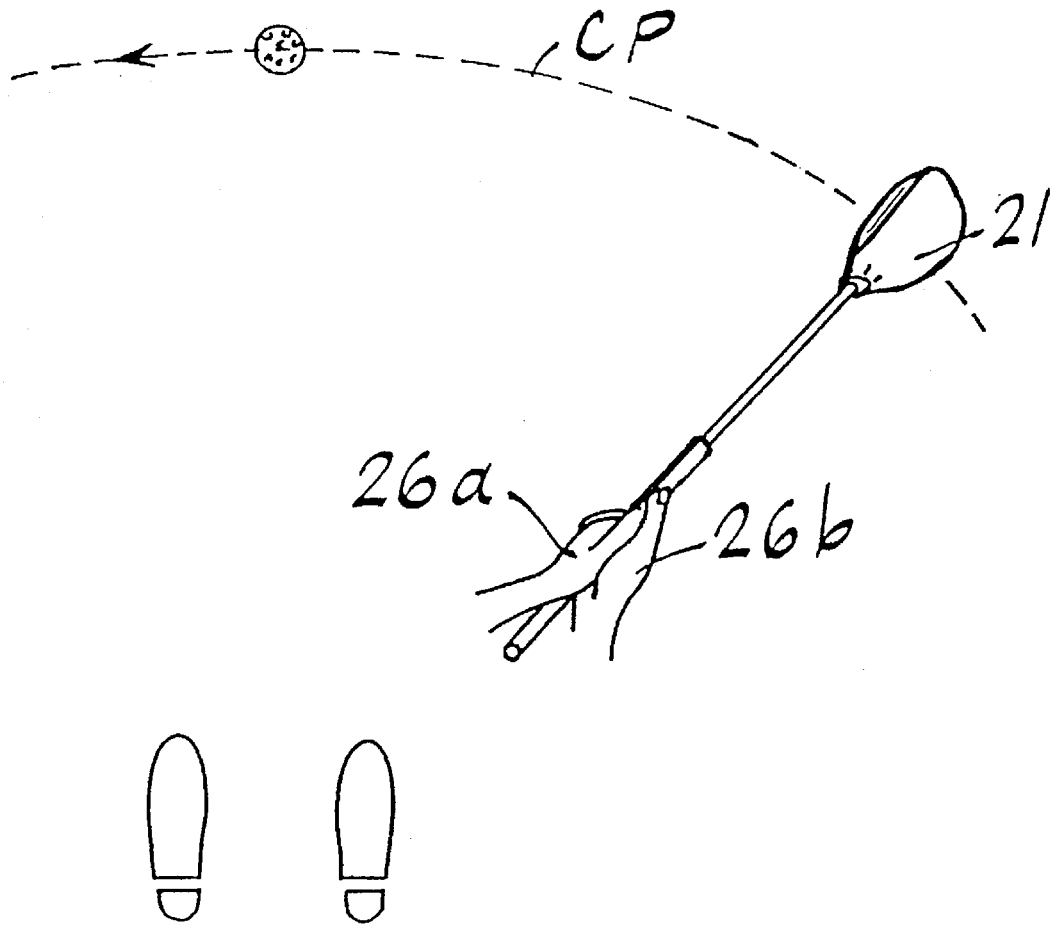
FIG. 11 is a view similar to FIG. 10 showing the club in its downswing position further below horizontal.
Figure 12:
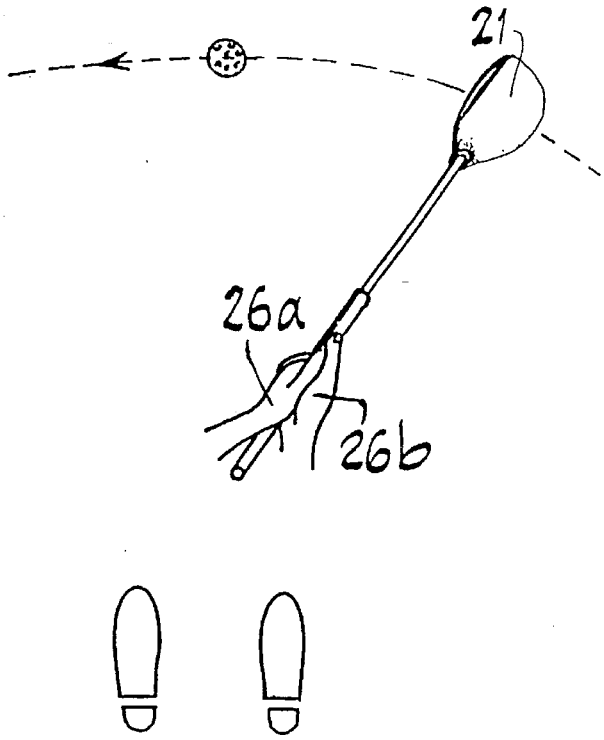
FIG. 12 is a further view similar to FIG. 11 showing a further club position closer to the ball.
Figure 13:
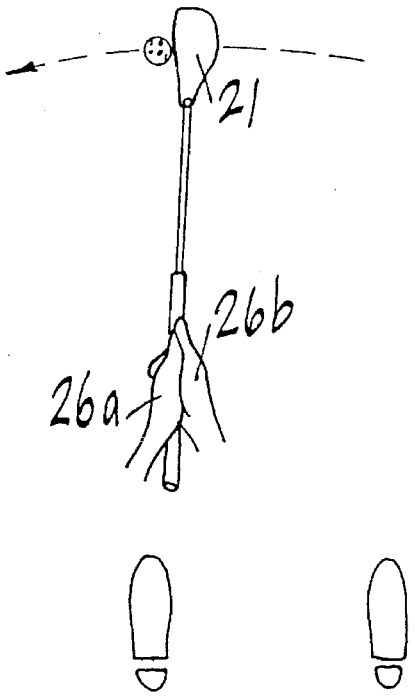
FIG. 13 is a further view similar to FIG. 11 showing club-ball contact position.

Turning to FIGS. 10, 10*a* and 11–13, club 20 having club head 10 (or head 15) is swung at ball 23 by a golfer having feet 24*a*, 24*b*, hands 26*a*, 26*b*. Full back swing (position 4)

is shown in FIG. 10. Hands 26*a*, 26*b* are represented in the position by hand knuckles 25. In FIG. 10 the shaft is horizontal at the top of the backswing. Turning to Table II below and in FIG. 10*a*, the club has progressed in the downswing again to a horizontal shaft position. In FIG. 11, the downswing has continued to 60° from the vertical (position 3); the club position 30° from the vertical as the downswing continues is shown in FIG. 12 (position 2) and the position at impact is shown in FIG. 13 (position 1). The swing path and face angle relative to the airstream velocity is preferably approximately as follows:

TABLE II

| Position and Figure | Shaft Angle from Vert | Face Angle to Airstream | Shaft Angle to Airstream | Relative Velocity Downswing |
|---|---|---|---|---|
| 1 (FIG. 13) | 0° | 90° | 88° | 100% |
| 2 (FIG. 12) | 30° | 60° | 88° | 100% |
| 3 (FIG. 11) | 60° | 30° | 84° | 90% |
| 4 (FIG. 10) | 90° | 0° | 79° | 80% |

As the club descends from a position where the shaft is horizontal to the ground to the point of ball impact, the club face closes and the face angle to airstream goes from 0° to 90°. After reaching position 2 the face angle relative to the air stream passing over and around the clubhead remains the same while the club head velocity decreases. These above club positions are representative of typical golf swing and attendant aerodynamic conditions. The final portion of the downswing where the highest velocities occur and a reduction in drag accomplished by the aerodynamics of hosel surfaces CS and CS' can be most beneficial.

The aerodynamic hosel fairing of this invention is based on the airflow orientation during the club down swing. The fairing is oriented to reduce the drag throughout the final swing regime while not increasing drag in any one area. Section AA is oriented so that it is streamlined to reduce drag in the impact orientation. This part of the hosel remains in the airstream throughout the final phases of the downswing. Section BB which defines the lower portion of CS and CS' is oriented to provide streamlining for the orientations of the clubhead from 20–40° prior to impact. Both AA and BB sections and surface CS therebetween are designed to avoid additional drag for the other non-primary portions of the swing.

Trip step 15*t* creates a turbulent mixing of the boundary layer of air that reduces the amount of flow separation over the face in turn reducing the drag of the clubhead. Trip step 15*t* is usually larger on top of the face than the bottom due to canting of this corner from the loft of the club. The fairings are primarily in effect during the impact because of a surface roughening effect. The clubhead further has a tapered toe to sole shape that reduces any tendency of flow separation over a head with a distinct corner between the sole and toe. This feature also reduces the overall clubhead drag.

A further feature is the general shape and design of the clubhead which improves sole performance from a variety of lies. The dual runner system has a much smaller contact area with the ground than a club without this type of system. Additionally, the runners retain the same radius as the clubhead to allow playability from rough and uneven lies.

I claim:

1. A golf club having a shaft with a centerline, a hosel, a head, and a ball-striking face on the head, the improvement comprising:

a) a hosel profile surface between a first and second plane passing through the shaft centerline at right angles to such centerline;

b) a third vertical plane at right angles to the first and second planes and to the ball-striking face;

c) an upper hosel circumference having a profile defined by the first plane with the circumference having a teardrop shape with a forward semicircular surface and a rearward half oval surface, said upper hosel profile oriented at a first acute angle to the third plane; and d) a lower hosel circumference having a profile defined by the second plane having substantially the same shape as the upper hosel circumference and oriented at a second acute angle to the third plane, wherein the first acute angle and the second acute angle are not the same.

2. The golf club of claim 1 in which the first acute angle is about 12 degrees.

3. The golf club of claim 1 in which the second acute angle is about 14 degrees.

4. The golf club of claim 1 in which the profile acute angles are on the toe side of the third vertical plane.

5. The golf club of claim 1 having a trip step.

6. The golf club of claim 1 having runner elements on the bottom of the head.

7. The golf club of claim 1 having a tapered toe.

8. A golf club having a shaft with a centerline, a hosel, a head, and a ball-striking face on the head, said hosel having a first end and a second end, the first end being adjacent to said shaft, the second end being adjacent to said head;

the first end having a first cross-sectional profile with a forward semicircular surface and a rearward partial oval surface;

the second end having a second cross-sectional profile with a forward semicircular surface and a rearward partial oval surface;

the rearward partial oval surface of the second cross-sectional profile being larger than that of the first cross-sectional profile; and wherein the first cross-sectional profile and the second cross-sectional profile are not parallel with each other.

9. The club of claim 8, wherein each of the first and the second cross-sectional profiles is oriented about a center line and wherein the center lines of the first and the second profiles are oriented at an acute angle, wherein the acute angle of the first and second profiles are not the same.

* * * * *